United States Patent [19]

Tai

[11] Patent Number: 4,885,101

[45] Date of Patent: Dec. 5, 1989

[54] LAUNDRY DETERGENTS CONTAINING FABRIC-SOFTENING CLAYS BETWEEN 150 AND 2000 MICRONS IN SIZE

[75] Inventor: Ho T. Tai, Lambersart, France

[73] Assignee: Lever Brothers Company, New York, N.Y.

[21] Appl. No.: 269,384

[22] Filed: Nov. 9, 1988

[30] Foreign Application Priority Data

Nov. 13, 1987 [GB] United Kingdom ..... 8726675

[51] Int. Cl.[4] ..... C11D 3/12; C11D 3/14; C11D 17/06; D06M 11/06

[52] U.S. Cl. ..... 252/8.6; 252/90; 252/131; 252/140; 252/174.25

[58] Field of Search ..... 252/131, 174.25, 140, 252/8.6, 90

[56] References Cited

U.S. PATENT DOCUMENTS

| | | | |
|---|---|---|---|
| 3,862,058 | 1/1975 | Nirschl et al. | 252/528 |
| 4,062,647 | 12/1977 | Storm et al. | 8/137 |
| 4,321,157 | 3/1982 | Harris et al. | 252/174.25 |
| 4,472,287 | 9/1984 | Ramachandran et al. | 252/8.7 |
| 4,526,702 | 7/1985 | Pan et al. | 252/174.25 |
| 4,609,473 | 9/1986 | Ramachandran et al. | 252/8.6 |
| 4,626,364 | 12/1986 | Bauman | 252/8.8 |
| 4,632,768 | 12/1986 | Atkinson | 252/8.8 |
| 4,767,546 | 8/1988 | Weinstein | 252/8.6 |
| 4,786,422 | 1/1988 | Kern | 252/8.8 |
| 4,806,253 | 2/1989 | St. Laurent et al. | 252/8.8 |

FOREIGN PATENT DOCUMENTS 2138037 10/1984 United Kingdom .

*Primary Examiner*—Paul Lieberman
*Assistant Examiner*—Ardith Beadles-Hay
*Attorney, Agent, or Firm*—Milton L. Honig

[57] ABSTRACT

A detergent composition suitable for washing and softening fabrics comprises a detergent active material, a detergency builder such as sodium tripolyphosphate and a fabric softening clay material, such as a smectite clay, which is ground to a particle size of 150 to 2000 microns. The use of ground clay avoids the use of dusty powdered clay and avoids the need for costly agglomeration while providing surprisingly good softening benefits.

4 Claims, No Drawings

LAUNDRY DETERGENTS CONTAINING FABRIC-SOFTENING CLAYS BETWEEN 150 AND 2000 MICRONS IN SIZE

This invention relates to detergent compositions, in particular to detergent compositions for washing fabrics and providing said fabrics with a softening benefit.

It is common practice to wash fabrics in detergent compositions which contain a detergent active material for removing the soil from the fabrics. With some fabrics, especially of natural origin, repeated washing can lead to fabric harshness, giving the fabrics an unpleasant feel. For some years fabric conditioning products have been available, intended inter alia for alleviating this fabric harshness by softening the fabrics in a post washing step, e.g. in the rinse step of a fabric laundering process. There has been a desire to provide a single detergent composition which would be capable of both washing and softening fabrics to overcome the inconvenience of using separate products. According to GB 1400898 (Procter & Gamble) a possible solution to this problem is to include in the detergent composition a three-layer smectite clay containing material having a cation exchange capacity of at least 50 meq/100g together with an anionic or similar detergent active material. It is recommended that the clay be spray-dried with other components of the composition. In GB 2138 037 (Colgate-Palmolive) these and other clays can be used in a bleach containing detergent composition containing specific levels of anionic and nonionic detergent actives if the clay is in the form of fine particles which are bound together to form agglomeretes of a suitable size for incorporating in a powdered detergent composition. This need for agglomeration is said to be necessary in order that the clay disperses rapidly when the product is added to water to form the wash liquor. Agglomeration however adds to the product cost. Spray drying the clay with other components can lead to reduced softening performance, while the addition of fine powdered clay to the composition generates dust handling problems. Further, the use of clays from some sources results in poor product colour.

We have now surprisingly discovered that the problems can be at least partially alleviated and that effective fabric softening from a clay containing composition is possible when the clay is incorporated in a form defined by the present invention, according to which there is provided a detergent composition comprising (i) a detergent active material (ii) a detergency builder and (iii) a fabric softening clay containing material which is ground to an average primary particle size of between 150 microns and 2000 microns.

The detergent active material may be selected from non-soap anionic, ampholytic, zwitterionic or nonionic detergent active materials or mixtures thereof. Particularly preferred are mixtures of anionic and nonionic detergent active materials such as a mixture of an alkali-metal salt of an alkyl benzene sulphonate together with an alkoxylated alcohol The level of detergent active material or materials in the composition may be from 2% to 50%, most preferably from 5% to 30% by weight.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_2O$ alpha-olefins, with $SO_3$ and then neutralising and hydrolysing the reaction product. The preferred anionic detergent compounds are sodium ($C_{11}$–$C_{15}$) alkyl benzene sulphonates and sodium alkyl ($C_{16}$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, i.e. 5 to 25 units of ethylene oxide per molecule, the condensation products of aliphatic 8) primary or secondary linear or branched alcohols with ethylene oxide, generally 5 to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

The detergency builder may be any material capable of reducing the level of free calcium ions in the wash liquor and will preferably provide the composition with other beneficial properties such as the generation of an alkaline pH, the suspension of soil removed from the fabric and the suspension of the fabric softening clay material. The level of the detergency builder may be from 10% to 70% by weight, most preferably from 25% to 50% by weight.

Examples of detergency builders include precipitating builders such as the alkali metal carbonates, bicarbonates, ortho phosphates, sequestering builders such as the alkali metal tripolyphosphates or nitrilotriacetates, or ion-exchange builders such as the amorphous alkali-metal aluminosilicates or the zeolites.

The clay containing material may be any such material capable of providing a fabric softening benefit. Usually these materials will be of natural origin containing a three-layer swellable smectite clay which is ideally of the calcium and/or sodium montmorillonite type. The effectiveness of a clay containing material as a fabric softener will depend inter alia on the level of smectite clay. Impurities such as calcite, feldspar and silica will often be present. Relatively impure clays can be used provided that such impurities are tolerable in the composition.

We have surprisingly found that effective fabric softening is possible even when the average primary particle size is above 150 microns. A primary particle size of more than 2000 microns is not desirable as this may lead to segregation in the product. A preferred average primary particle size is from 200 microns to 1000 microns. Some agglomeration of the primary particles may occur during processing, but we have found this to be not essential to the performance of the product. In the context of the present invention, particle sizes are to be measured by sieve analysis and an average particle size is determined on a by-weight basis. It is preferred that the majority of particles have a size falling within the given range.

The level of the fabric softening clay material in the composition should be sufficient to provide a softening benefit, such as from 1.5% to 35% by weight, most preferably from 4% to 15% by weight, calculated on the basis of the clay mineral per se.

In addition to the detergent active material, the detergency builder and the clay containing material, the compositions according to the invention optionally contain other ingredients.

Apart from the components already mentioned, a detergent composition of the invention can contain any of the conventional additives in the amounts in which such additives are normally employed in fabric washing detergent compositions. Examples of these additives include the lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as tricloroisocyanuric acid, inorganic salts such as sodium sulphate, other fillers such as kaolin, and, usually present in very minor amounts, fluorescent agents, perfumes, other enzymes such as proteases and amylases, germicides and colourants.

It is preferred that the compositions of the present invention be in granular form. They may be prepared by any of the methods commonly used in the art, but it is preferred that the ground clay containing material be added to a base powder containing other ingredients and dry mixed therewith. The base powder may be made, for example, by spray drying a slurry containing the necessary ingredients. Any heat sensitive ingredients can be added separately, before, together with or subsequent to the ground clay containing material.

The invention will now be illustrated by the following non-limiting example:

EXAMPLE 1

Crude ground calcium clay supplied ex-CECA under the trade name "Clarsol" was sieved to reject particles having a size below 200 microns and above 1000 microns. The sieved material was used to prepare a detergent composition having the following formulation:

| Ingredients | % by Weight |
|---|---|
| Anionic detergent active[1] | 5.5 |
| Soap[2] | 0.5 |
| Nonionic detergent active[3] | 2.5 |
| Sodium tripolyphosphate | 27.0 |
| Sodium carbonate | 4.0 |
| Sodium silicate ($Na_2O:SiO_2$ = 1:2) | 4.0 |
| Sodium perborate tetrahydrate (post dosed) | 17.0 |
| Clay (post dosed) | 12.0 |
| Enzyme, sodium sulphate minor ingredients and water | Balance |

Notes
1 - Sodium linear alkyl benzene sulphonate
2 - Sodium hardened rapeseed soap
3 - $C_{13-15}$ Alcohol ethoxylated with an average of 7EO groups per molecule This product was tested against a similar composition which differed only in that the clay was replaced by an equal weight of sodium sulphate. Both new terry towelling and pre-harshened terry towelling were washed with these products in a laboratory scale apparatus. The washing time was 15 minutes at 40° C. The product was dosed at a level of 4 g/1 to water having a hardness of 30° FH. (equivalent to a free calcium ion concentration of $30\times10^{-4}$ molar) After washing, rinsing and line drying three times, the fabrics were assessed for softness by a panel of experts.

After three washes the fabrics washed in the product containing the clay were noticeably softer than those washed in the control product.

In a washing machine test with the same products, detergency efficiency, enzyme efficiency and soil redeposition were measured using standard techniques and no significant loss in efficiency attributable to the presence of clay could be detected.

EXAMPLES 2 and 3

Useful compositions according to the invention are as follows:

| | EXAMPLE NO | |
|---|---|---|
| Ingredients (% by weight) | 2 | 3 |
| Spray dried base | | |
| Anionic detergent active | 27 | 16 |
| Sodium tripolyphosphate | 24 | 11 |
| Sodium silicate | 7 | 12 |
| Sodium sulphate* | 11 | 18 |
| Sodium carbonate | 3 | 5 |
| Water and minors | balance | balance |
| Post dosed ingredients | | |
| Sodium carbonate | 6 | 9 |
| Sieved clay (as Example 1) | 8 | 14 |
| Enzymes | + | + |
| Perfume | + | + |
| | 100 | 100 |

*or a mixture of sodium sulphate and kaolin

EXAMPLE 4

This example compares the performance of clay in various forms. The clay used was CULVIN ex Cullinan, South Africa, in particular the sieve fraction between 250 and 1000 microns. This material is referred to below as "Ground clay". The material referred to below as "Powdered clay" was produced by grinding Ground clay to a particle size below 75 microns. Four spray-dried detergent compositions were prepared as set out below, containing respectively no clay, Ground clay added via the slurry, post-dosed Ground clay and Powdered clay. The formulation of the compositions was as follows:

| Ingredient | Parts by weight |
|---|---|
| Anionic detergent active | 24.7 |
| Nonionic detergent active | 2.1 |
| Soap | 1.0 |
| Zeolite | 34.0 |
| Sodium carbonate | 10.3 |
| Sodium alkaline silicate | 4.1 |
| Clay | 10.0 or absent |
| Moisture and miscellaneous | 13.8 |

The four compositions were tested for softening performance in a laboratory scale apparatus under the following conditions.

| | |
|---|---|
| Wash temperature | 20° C. |
| Wash time | 10 minutes |
| Liquor/cloth ration | 25:1 |
| Cloth type | Desized Terry Towelling Water |
| hardness | 9° FH ($6 \times 10^{-4}$ molar free calcium plus $3 \times 10^{-4}$ molar free magnesium) |
| Dosage | 0.89 g/l (or 0.8 g/l where clay was absent |

After washing and rinsing for 4 cycles, the fabrics were dried and assessed for softness by a panel of experts. The results were:

| Example No. | Clay type | Softness difference |
|---|---|---|
| 4A | None | 0.0 |
| 4B | Ground clay via slurry | 0.275 |
| 4C | Post-dosed ground clay | 0.345 |
| 4D | Post-dosed powdered clay | 0.552 |

A difference of 0.325 softness units is significant. Therefore these results show that the Ground clay processed through the slurry shows no significant improvement in softening performance over the use of no clay. With post-dosed clay significant softening is achieved, but no significant difference is detected between Ground clay and powered clay.

The four compositions were tested for dusting using the method described by Wells and Alexander in Powder Technology 19 1978) 271–277 (Total Dust). The results were:

| Example No. | Clay type | Total Dust (mg/100 g) |
|---|---|---|
| 4B | Ground clay via slurry | 0.05 |
| 4C | Post-dosed Ground clay | 0.2 |
| 4D | Post-dosed Powdered clay | 5.1 |

These results show the inferior performance of the composition containing powdered clay.

I claim:

1. A detergent composition comprising a detergent active from 2 to 5% by weight of material, from 10 to 70% a detergency builder and from 1.5 to 35% by weight of a fabric softening clay material, characterised in that the clay material is ground clay having an average primary particle size of between 150 and 2000 microns.

2. A composition according to claim 1, wherein the clay material comprises a three-layer swellable smectite clay.

3. A composition according to claim 1, wherein the clay material is a ground clay having an average primary particle size of between 200 and 1000 microns.

4. A composition according to claim 1 comprising a spray-dried base powder containing detergent active material and detergency builder, dry-mixed with the ground clay.

* * * * *

UNITED STATES PATENT AND TRADEMARK OFFICE

CERTIFICATE OF CORRECTION

PATENT NO. : 4,885,101

DATED : December 5, 1989

INVENTOR(S) : Ho Tan Tai

It is certified that error appears in the above—identified patent and that said Letters Patent is hereby corrected as shown below:

In claim 1 at column 6, line 32, "5%" should read --50%--.

Signed and Sealed this

Twentieth Day of August, 1991

*Attest:*

HARRY F. MANBECK, JR.

*Attesting Officer*

*Commissioner of Patents and Trademarks*